US005862995A

United States Patent [19]

Wu

[11] Patent Number: 5,862,995

[45] Date of Patent: Jan. 26, 1999

[54] HIGH PRESSURE FLUID PASSAGE SEALING FOR INTERNAL COMBUSTION ENGINE FUEL INJECTORS AND METHOD OF MAKING SAME

[75] Inventor: Tong Wu, Kentwood, Mich.

[73] Assignee: Diesel Technology Company, Kentwood, Mich.

[21] Appl. No.: 626,128

[22] Filed: Apr. 1, 1996

[51] Int. Cl.[6] ..... F02M 59/00

[52] U.S. Cl. ..... 239/533.2; 239/584; 277/236; 277/DIG. 6

[58] Field of Search ..... 239/88–91, 95, 239/585.1, 588.3, 583, 584, 533.2; 277/236, DIG. 6

[56] References Cited

U.S. PATENT DOCUMENTS

| | | | |
|---|---|---|---|
| 3,900,939 | 8/1975 | Greachen . | |
| 4,470,545 | 9/1984 | Deckard et al. | 239/88 |
| 4,485,969 | 12/1984 | Deckard et al. | 239/88 |
| 4,568,021 | 2/1986 | Deckard et al. | 239/88 |
| 4,622,942 | 11/1986 | Nozaki et al. | 123/446 |
| 4,669,659 | 6/1987 | LeBlanc et al. | 239/91 |
| 4,754,538 | 7/1988 | Stewart . | |
| 4,770,725 | 9/1988 | Simpson et al. | 148/402 |
| 4,941,612 | 7/1990 | Li | 239/88 |
| 4,951,874 | 8/1990 | Ohnishi et al. | 239/88 |
| 4,976,327 | 12/1990 | Abujudom II et al. | 180/68.2 |
| 4,986,244 | 1/1991 | Kobayashi et al. | 123/488 |
| 5,022,662 | 6/1991 | Yasui | 277/235 B |
| 5,081,978 | 1/1992 | Sumida et al. | 123/588 |
| 5,231,871 | 8/1993 | Arai et al. | 73/118.2 |
| 5,275,337 | 1/1994 | Kolarik et al. | 239/91 |
| 5,370,095 | 12/1994 | Yamaguchi et al. | 123/446 |
| 5,375,575 | 12/1994 | Ohuishi et al. | 123/446 |
| 5,385,396 | 1/1995 | Beck et al. | 303/119.2 |
| 5,443,209 | 8/1995 | Van Alls Burg | 239/90 |
| 5,603,302 | 2/1997 | Minagawa et al. | 123/456 |

FOREIGN PATENT DOCUMENTS 0 580 325 1/1994 European Pat. Off. .

OTHER PUBLICATIONS

"Shape Memory Alloys" ASM International Darele E.Hodgson, Ming H. Wu and Robert J. Bierman 1991, pp. 897–902, (No date).

*Primary Examiner*—Andres Kashnikow
*Assistant Examiner*—Lisa Ann Douglas
*Attorney, Agent, or Firm*—Bill C. Panagos

[57] ABSTRACT

A fuel injector assembly for an internal combustion engine includes an injector body having a control valve in fluid communication with a source of fuel. A fuel nozzle assembly is employed to disperse fuel from the assembly. A high pressure fuel passage provides fluid communication between the control valve and the fuel nozzle assembly. The high pressure fuel passage has at least one end opening through the injector body and having an inner diameter. A shape memory alloy plug seals the open end of the fuel passage. The plug has a first diameter smaller than the inner diameter when inserted into the open end and a second diameter in sealing engagement with the inner diameter upon undergoing a metallurgical phase change from martinsite to austenite such that the plug generates a seal with the fuel passage. In addition, a method of making the fuel injector assembly employing a shape memory alloy plug to seal the high pressure fuel passage is also disclosed.

20 Claims, 3 Drawing Sheets

FIG-2
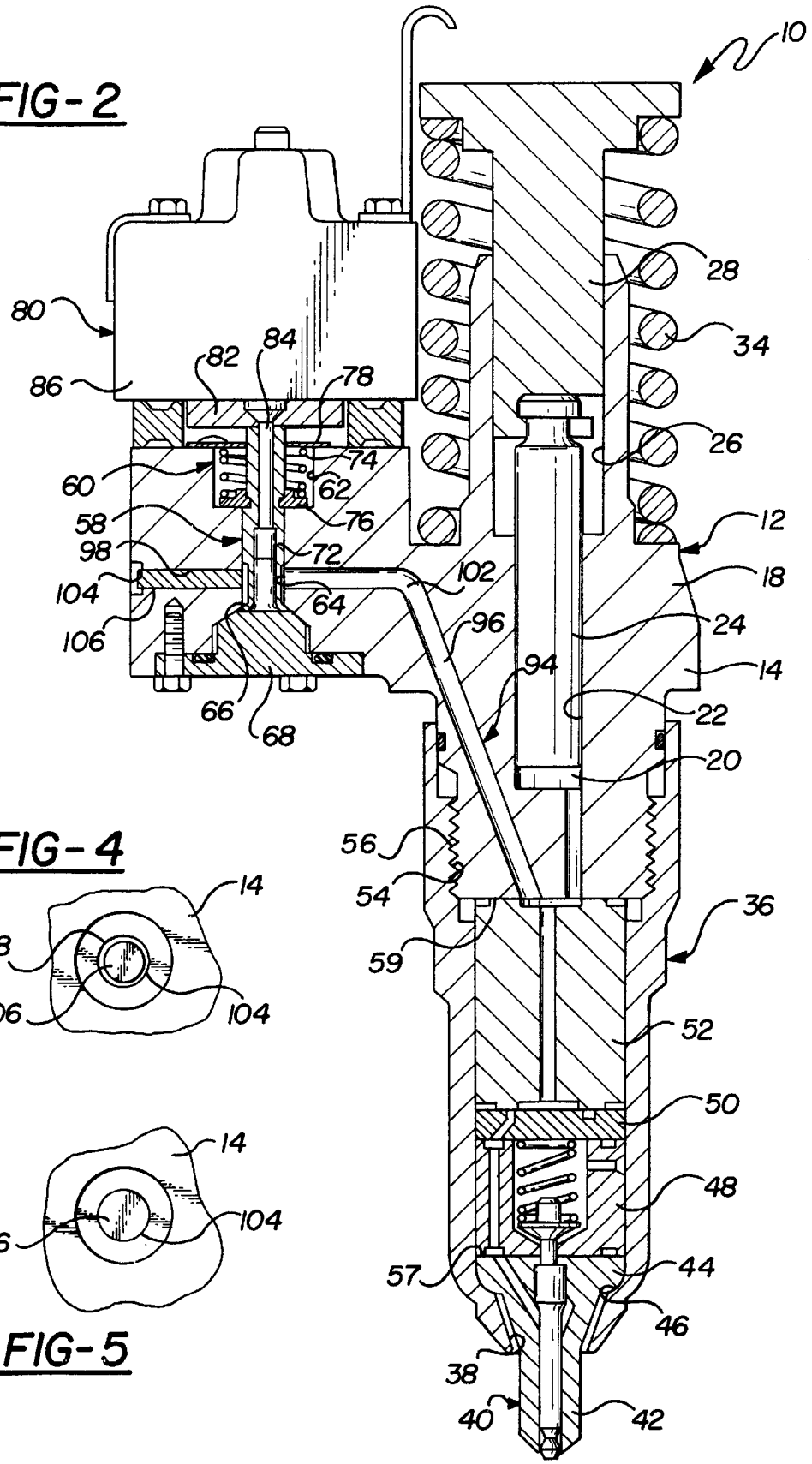
FIG-4
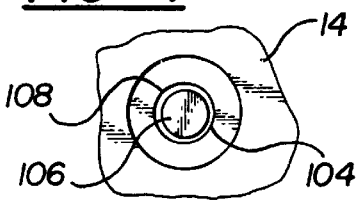
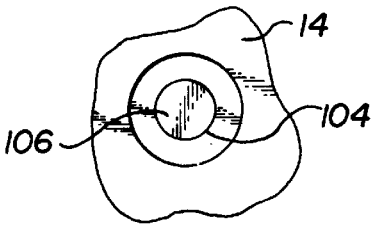
FIG-5

HIGH PRESSURE FLUID PASSAGE SEALING FOR INTERNAL COMBUSTION ENGINE FUEL INJECTORS AND METHOD OF MAKING SAME

BACKGROUND OF THE INVENTION

1. Field of the Invention

The present invention relates, generally, to a high pressure fuel injector for internal combustion engines. More specifically, the invention relates to a fuel injector which employs a shape memory alloy to plug a high pressure fuel passage and a method of manufacturing same.

2. Description of the Related Art

Fuel injector assemblies are employed in internal combustion engines for delivering a predetermined, metered amount of fuel to the combustion chamber at preselected intervals. In the case of compression ignition, or diesel engines, the fuel is injected into the combustion chamber at relatively high pressures. Presently, conventional injectors are delivering this fuel at pressures as high as 32,000 psi. These are fairly high pressures and have required considerable engineering attention in ensuring structural integrity of the injector, good sealing properties, and effective atomization of the fuel within the combustion chamber. However, increasing demands on greater fuel economy, cleaner burning, fewer emissions, and $No_x$ control have placed, and will continue to place, even higher demands on the engine's fuel delivery system including increasing the fuel pressure within the injector.

Fuel injectors presently employed in the related art typically include a high pressure fuel passage which extends between a solenoid actuated control valve and the plunger cylinder in the injector body. Fuel at relatively low pressure is supplied to the control valve which then meters the delivery of the fuel at predetermined intervals through the high pressure fuel passage to the plunger cylinder. The fuel ultimately exits the injector through a fuel nozzle.

The high pressure fuel passage is often formed in the injector body by drilling a hole from one side of the injector body through a chamber formed to accommodate the structure of the control valve and between the control valve and the plunger cylinder. The opening in the side of the injector body formed from the drilling is then sealed with a steel plug through a brazing operation. One of the disadvantages with this arrangement is that the brazed plug requires expensive tools and tapered hole machining during the manufacturing process and expensive metal removal after the high temperature braze and hardening process. Further, as the demand for higher fuel injection pressure has increased, the reliability of brazed plugs in this environment has not always met the high manufacturing quality standards required in the relevant industries. More specifically, the brazed plugs can leak and even fail under the high injection pressures. Further, both the plug and the fuel passage are subjected to cyclical pressures ranging between 0 and the peak stress generated by the fuel pressure. The alternating stress amplitude adversely effects the fatigue life of the injector body and can result in early failure through body cracks.

Thus, there is a need in the art to provide a better seal for the high pressure fuel passage of a fuel injector which reduces costs by eliminating the brazing process presently employed in the related art and while providing a very secure, tight seal at the open end of the high pressure passage that resists leaking, even under very high pressures. Further, there is a need in the art for a sealing mechanism in this environment which reduces the stress amplitude on the injector body generated in the high pressure fuel passage.

SUMMARY OF THE INVENTION

The subject invention overcomes the disadvantages in the related art in a fuel injector assembly for an internal combustion engine. More specifically, the fuel injector assembly of the present invention includes an injector body having a control valve in fluid communication with a source of fuel and a fuel nozzle assembly through which fuel is dispersed from the assembly. In addition, the injector assembly includes a fuel passage providing fluid communication between the control valve and the fuel nozzle assembly. The fuel passage has at least one end opening through the injector body and defines an inner diameter or periphery. A shape memory alloy plug is employed to seal the one open end of the fuel passage. The shape memory alloy plug has a first diameter which is smaller than the inner diameter when inserted into the open end of the fuel passage. The shape memory alloy plug converts to a second, larger diameter in sealing engagement with the inner diameter when the shape memory alloy plug undergoes a metallurgical phase change from martinsite to austenite such that the plug expands and generates a seal with the fuel passage.

In addition, the present invention includes a method of manufacturing the fuel injector including the steps of sizing the shape memory alloy plug such that it has a first diameter which is smaller than the inner diameter of the open end of the fuel passage while at a martinsitic state. The shape memory alloy plug is then inserted into the open end of the fuel passage. The metallurgical phase change is then induced in the shape memory alloy plug such that it changes from martinsite to austenite wherein the plug defines a second diameter which is larger than the first diameter and forms a seal with the fuel passage.

In this way, the present invention eliminates the brazing operation necessary for employing a steel brazed plug in the open end of the fuel passage. Furthermore, the present invention also eliminates the need for braze inspection, any plug metal removal after the hardening process, plug core hardening and nitriding as well as any material handling expenses between these numerous process.

Thus, one advantage of the present invention is that a seal is provided for the open end of the high pressure fuel passage in a fuel injector while at the same time eliminating the costs associated with the brazed steel plug of the related art. Still another advantage of the present invention is that the shape memory alloy plug provides a very secure, tight seal at the open end of the high pressure fuel passage that will not leak, even under very high pressures. Still another advantage of the present invention is that the shape memory alloy plug generates a stable tensile hoop stress on the fuel passage which reduces the stress amplitude on the injector body generated in this passage.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 2 is a cross-sectional side view of an electromagnetic fuel injector of the present invention illustrating another arrangement of the fuel passage through the injector body;

FIG. 4 is an end view of the open end of the fuel passage illustrating the shape memory alloy plug of the present invention while at its first, smaller diameter.

FIG. 5 is an end view of the open end of the fuel passage illustrating the shape memory alloy plug of the present invention while at its second, larger diameter which seals the opening.

DESCRIPTION OF THE PREFERRED EMBODIMENT(S)

Figure 1:
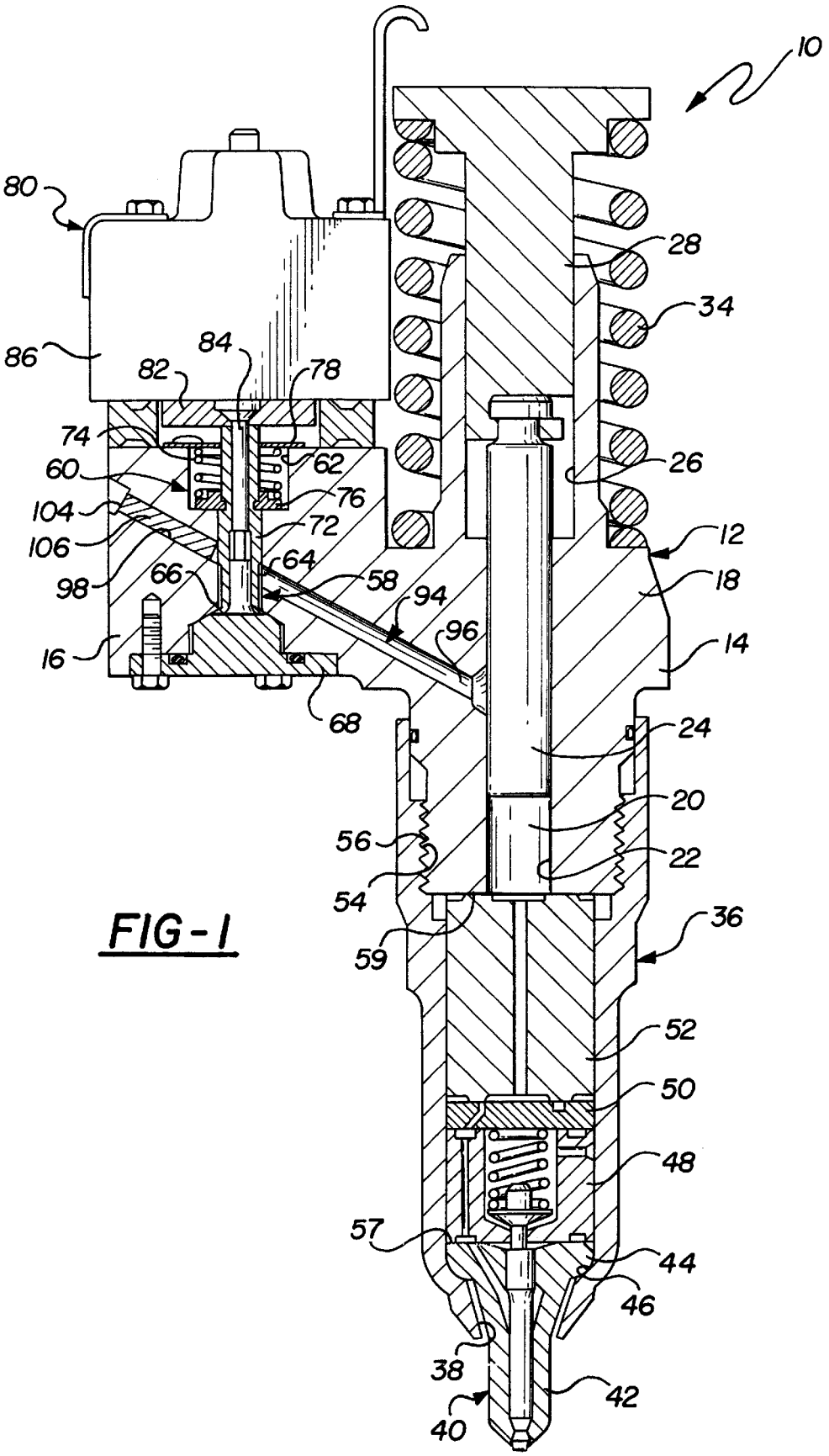
FIG. 1 is a cross-sectional side view of an electromagnetic fuel injector of the present invention illustrating one arrangement of the high pressure fuel passage in the injector body.
Figure 3:
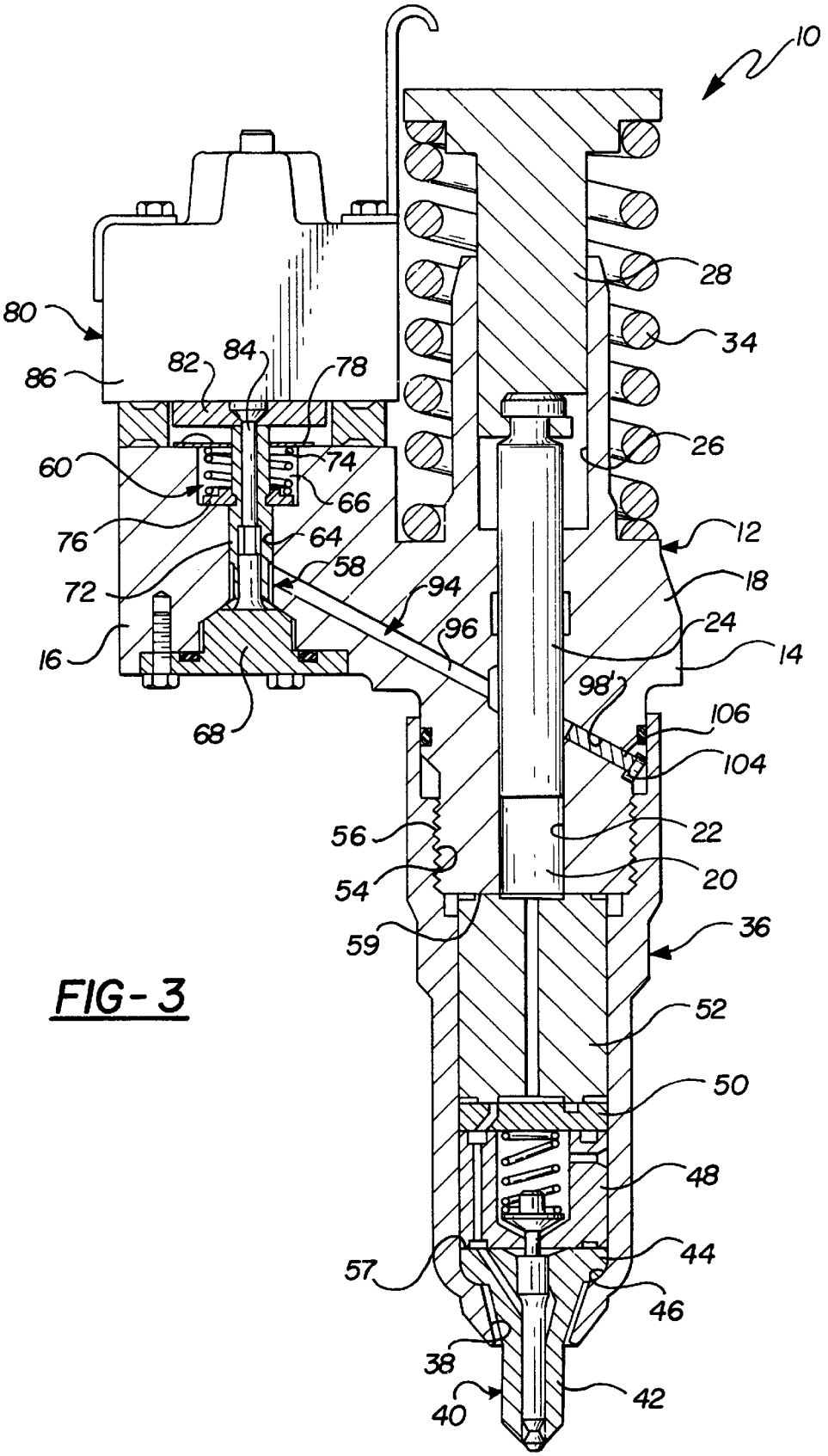
FIG. 3 is a cross-sectional side view of an electromagnetic fuel injector of the present invention illustrating yet another arrangement of the high pressure passage through the injector body.

Referring now to FIGS. 1 through 3, there is generally shown at 10 an electromagnetic fuel injector constructed in accordance with the present invention. More specifically, a fuel injector pump assembly 10 is shown in the figures having an electromagnetically actuated, pressure balanced control valve incorporated therein to control fuel discharge from the injector portion of this assembly 10 in a manner to be described.

As illustrated in the drawings, the electromagnetic fuel injector assembly 10 includes an injector body 12 which has a vertical main body portion 14 and a side body portion 16. The main body portion 14 includes a bushing 18 which defines a stepped, cylindrical bore 20 therethrough. The stepped, cylindrical bore 20 includes a cylindrical lower wall 22 which slideably receives a pump plunger 24. In addition, the stepped, cylindrical bore 20 includes an upper wall 26 of larger internal diameter to slideably receive a plunger actuator follower 28. The plunger actuator follower 28 extends out one end of the main body 14 whereby it and the pump plunger 24 connected thereto are adapted to be reciprocated by an engine driven cam or rocker as conventionally known in the art. A stop pin (not shown) extends through an upper portion of the main injector body portion 14 into an axial groove in the plunger actuator follower 28 to limit upward travel of the follower induced under the bias of a plunger return spring 34.

A nut, generally indicated at 36, is threaded to the lower end of the main body portion 14 and forms an extension thereof. The nut 36 has an opening 38 at its lower end through which extends the lower end of a combined injector valve body or nozzle assembly, generally indicated at 40. The nozzle assembly 40 includes a spray tip 42. The spray tip 42 is enlarged at its upper end to provide a shoulder 44 which seats on an internal shoulder 46 provided by the through counter-bore in the nut 36. Between the spray tip 42 and the lower end of the main injector body 14, there is positioned in the nozzle assembly 40, in sequence starting from the spray tip 42, a rate spring cage 48, a spring retainer 50 and a director cage 52. As illustrated in the figures, these elements are formed as separate parts for ease of manufacturing and assembly. The nut 36 is provided with internal threads 54 for mating engagement with the external threads 56 at the lower end of the main body portion 14. The threaded connection of the nut 36 to the main body portion 14 holds the spray tip 42, rate spring cage 48, spring retainer 50 and director cage 52 clamped and stacked end-to-end between the upper face 57 of the spray tip 42 and the bottom face 59 of the main body portion 14. All of these above described elements have lapped mating surfaces whereby they are held in pressure sealed relation to each other.

The delivery of fuel from a source such as a fuel tank to the nozzle assembly 40 is controlled by means of a solenoid actuated, pressure balanced valve, generally indicated at 58 in the side body portion 16. The side body portion 16 is provided with a stepped vertical bore, generally indicated at 60, which defines a supply chamber 62 and an intermediate or valve stem guide portion 64. The valve 58 is received within the stepped vertical bore 60 and includes a head 66 which seats against a closure cap 68. The closure cap 68 is mounted to the underside of the side body portion 16 and in connection therewith forms a spill chamber (not shown). The valve 58 also includes a stem 72 extending upward from the head 66. The valve 58 is normally biased in a valve opening direction, downward with reference to FIG. 1, by means of a coil spring 74 which loosely encircles valve stem 72. One end of the spring 74 abuts against a washer like spring retainer 76 encircling the valve stem portion 72.

The other end of the spring 74 abuts against the lower face of a spring retainer 78. Movement of the valve 58 in the valve closing direction, upward with reference to FIG. 1, is effected by means of a solenoid assembly, generally indicated at 80. The solenoid assembly 80 includes an armature 82 having a stem 84 depending centrally from its head. The armature 82 is secured to the valve 58.

The solenoid assembly 80 further includes a stator assembly, having an inverted cup-shaped solenoid case 86. A coil bobbin, supporting a wound solenoid coil and a segmented multi-piece pole piece, are supported within the solenoid case 86 as is commonly known in the art. The solenoid coil is connected through electrical connectors, not shown, to a suitable source of electrical power via a fuel injection electronic control circuit, not shown. Thus, the solenoid coil can be energized as a function of the operating conditions of an engine in a manner well known in the art.

A high pressure fuel passage, generally indicated at 94, provides fluid communication between the control valve 58 and the fuel nozzle assembly 40. As shown in FIG. 1, the fuel passage 94 is formed by drilling a hole from one side of the side body portion 16 of the injector body 12 and between the control valve 58 and the stepped cylindrical bore 20. In this way, the fuel passage 94 defines a delivery portion 96 extending between the control valve 58 and the stepped cylindrical bore 20 and a stub portion 98 extending between the valve stem portion 64 in the control valve 58 and the side body portion 16. Alternatively, as shown in FIG. 2, the high pressure fuel passage 94 may be formed by drilling a pair of holes; one starting at the side of the side body portion 16 to form the stub portion 98 and the second beginning from the bottom face 59 of the main injector body portion 14 which meets the first drill hole at an elbow 102 to form the delivery portion 96.

On the other hand and as shown in FIG. 3, the high pressure fuel passage 94 may be formed by drilling a hole from one side of the main injector body portion 14 and through the stepped cylindrical bore 20 and between the stepped cylindrical bore 20 and the control valve 58. In this way, the high pressure fuel passage 94 defines a stub portion 98' extending between the stepped cylindrical bore 20 and the main injector body 14. In any event, and in each of the three embodiments shown in FIGS. 1–3, drilling the hole forms an opening 104 in either the side body portion 16 as shown in FIGS. 1 and 2 or the main body portion 14 as shown in FIG. 3. This opening 104 defines an inner diameter or periphery and must be sealed.

To this end, the present invention provides for a shape memory alloy plug 106 sealing the open end 104 of the stub portion 98, 98' of the high pressure fuel passage 94. The plug 106 has a first diameter which is smaller than the inner diameter when inserted into the stub portion 98, 98' through the open end 104. In addition, the shape memory alloy plug 106 has a second, larger diameter in sealing engagement with the inner diameter upon the shape memory alloy plug 106 undergoing a metallurgical phase change from martinsite to austenite such that the plug generates a seal with the fuel passage 94.

As used herein, the term "shape memory alloy" is applied to that group of metallic materials that demonstrates the ability to return to some previously defined shape or size when subjected to the appropriate thermal procedure. Generally, these materials can be plastically deformed at some relatively low temperature, and upon exposure to some higher temperature, will return to their shape prior to the deformation. Materials that exhibit shape memory only upon heating are referred to as having one-way shape memory. The present invention employs a one-way shape memory alloy. That is, upon cooling, the shape memory alloy does not undergo any shape change, even though the structure changes to martinsite. When the martinsite is strained up to several percent, however, that strain is retained until the material is heated, at which time shape recovery occurs. Upon recooling, the material does not spontaneously change shape, but must be deliberately strained if shape recovery is again desired. A shape memory alloy may be further defined as one that yields a thermal elastic martinsite. In this case, the alloy undergoes a martinsitic transformation of a type that allows the alloy to be deformed by a twinning mechanism below the transformation temperature. The deformation is then reversed when the twinning structure reverts upon heating to the parent phase.

The present invention employs a shape memory alloy plug which is preferably made of a nickel-titanium-niobium alloy having a composition of about 48 weight percent nickel, about 38 weight percent titanium, about 12 weight percent niobium and about 2 percent of other trace elements. The nickel-titanium-niobium alloy undergoes a single, shape change from its first, smaller diameter to its second, larger diameter corresponding to the metallurgical phase change from martinsite to austenite. Those skilled in the art will understand that a range of weight percent components of the shape memory alloy are possible without departing from the scope of the present invention. In addition, it is contemplated that other shape memory alloys, such as copper or iron based alloys could be used in the as components of the shape memory alloy.

The inner diameter of the open end 104 of the fuel passage 94 is greater than the first, smaller diameter of the shape memory alloy plug 106 so as to present a clearance 108 which is less than 1.5% of the plug's first, smaller diameter. Further, the plug 106 defines a shape along its longitudinal axis which is complementary to the shape of the open end 104 of the stub portion 98, 98' of the fuel passage 94 such that the plug 106 completely seals the open end 104 of the stub portion 98, 98' when the plug 106 is at its second, larger diameter.

At this second, larger diameter, the shape memory alloy plug 106 generates a hoop stress on the stub portion 98, 98' which is on the order of roughly 27,000 psi at −50° C. to 60,000 psi at 160° C. This static and stable, tensile hoop stress on the stub portion 98, 98' of the high pressure fuel passage 94 is exerted even at low fuel pressure. When the fuel pressure increases, the diameter of the fuel passage 94 and thus the stub portion 98, 98' will increase elastically which reduces the hoop stress generated by the plug 106. However, the total hoop stress on the injector body will change from roughly 27,000 psi (the lowest constrained stress) generated by the plug 106 to the peak stress generated by the fuel pressure rather than from zero to the peak stress generated by the fuel pressure as was previously the case with a brazed plug. In this way, the alternating stress amplitude in the stub portion 98, 98' of the high pressure fuel passage 94 is reduced resulting in fewer instances of injector body crack and, therefore, less failures. While the terms "diameter" and "periphery" have been used herein to describe the surfaces of the plug 106 and inner surface of the open end 104 in the fuel passage, it should be appreciated that the plug and opening may take the form of any complimentary geometric shape, such as square, rectangular, hex, etc.

The present invention is also directed toward a method of manufacturing the fuel injector assembly for an internal combustion engine having a shape memory alloy plug 106 which seals the open end 104 of a high pressure fuel passage. The method includes the steps of prestraining an annealed, shape memory alloy plug 106 while it is in a martinsitic state. This step includes cooling the plug 106 to a temperature in the range of −100° C. to −55° C. and preferably in the range of −100° C. to −80° C. The plug will then have a recoverable axial strain of 4.5 to 6 percent with 2.25 to 3 percent in the radial direction. The prestrained nickel-titanium-niobium shape memory alloy can be stored and handled at room temperature without inducing a phase change due to its wide thermal hysteresis. Thus, the shape memory alloy plug of the present invention takes advantage of the fact that the martinsite starting temperature for this alloy is $M_s$=−80° C. and the austenite starting temperature is $A_s$=55° C.

The method of the present invention further includes the step of sizing the shape memory alloy plug 106 such that it has a first diameter which is smaller than the inner diameter of the open end 104 while it is at its martinsitic state. The step of sizing the plug 106 includes cutting a rod of shape memory alloy plug 106 to a predetermined length. This step further includes centerless grinding the plug until it has a first diameter which is smaller than the opening 104 in the side of the injector body. Further, this step includes maintaining the temperature of the plug below 50° C. To this end, the plug 106 should be maintained in a coolant environment. It is also contemplated that the step of sizing the plug 106 by centerless grinding may be replaced by the steps of measuring the fuel passage 98, 98' and selecting by category measurement the plug as prestrained and cut to a predetermined length. Thus, the centerless grinding process step is eliminated.

Once the plug has been sized or select measured, it can then be inserted into the open end 104 of the fuel passage 94. The clearance between the plug 106 and the open end 104 when the plug is at its first diameter should be less than 1.5% of the plug diameter. The plug may be held in place by a fixture or any other suitable means.

The method further includes a step of inducing a metallurgical phase change in the shape memory alloy plug 106 from martinsite to austenite such that the plug defines a second diameter at it austenitic state which is larger than its first diameter and in sealing engagement with the inner diameter such that it forms a seal with the fuel passage 94. This step includes heating the injector body at a temperature range between 65° C. and 200° C. to transform the shape memory alloy plug from its martinsitic to its austenitic state. One of the important objectives of this method is to control the shape memory alloy's free recovery (free radial growth) and the constrained recovery contact stress. The free recovery is determined by the type of alloy and the manufacturing process of the shape memory alloy plug. For the annealed nickel-titanium-niobium alloy disclosed herein, the designed radial growth at 65° C. ($A_f$) is 2.25–3 percent of the plug's diameter. The radial contact stress under constrained recovery is determined by the unresolved strain change, plug heating, and the work condition temperature. The unresolved strain change is related to the plug/hole clearance. Normally, the larger amount of unused recovery (smaller clearance), the higher the radial stress. An average heating temperature for the injector body of about 160° C. will generate a full stress of about 60,000 psi for an annealed alloy and about 90,000 psi for the cold formed alloy. In the work temperature range of an injector body of between −55° C. and 200° C., the higher the temperature, the higher the radial stress.

Thus, the present invention provides a fuel injector assembly for an internal combustion engine employing a shape memory alloy plug to seal the high pressure fuel passage which reduces costs by eliminating the brazing process presently employed in the related art while providing a very secure, tight seal at the open end of the high pressure fuel passage that resists leaking, improves performance and reduces the alternating stress amplitude in the fuel passage.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel injector assembly for an internal combustion engine comprising:

an injector body having a control valve in fluid communication with a source of fuel, a fuel nozzle assembly through which fuel is dispersed from said assembly;

a fuel passage providing fluid communication between said control valve and said fuel nozzle assembly and having at least one end opening through said injector body and defining an inner diameter; and a shape memory alloy plug sealing said at least one open end of said fuel passage, said shape memory alloy plug having a first diameter smaller than said inner diameter when inserted into said at least one open end of said fuel passage and a second diameter in sealing engagement with said inner diameter upon said shape memory alloy plug undergoing a metallurgical phase change from martinsite to austenite such that said plug generates a seal with said fuel passage.

2. An assembly as set forth in claim 1 wherein said inner diameter of said at least one open end of said fuel passage is greater than said first, smaller diameter of said shape memory alloy plug so as to present a clearance which is less than 1.5 percent of said shape memory alloy plugs first, smaller diameter.

3. An assembly as set forth in claim 1 wherein said shape memory alloy plug defines a shape along its longitudinal axis which is complimentary to the shape of said at least one open end of said fuel passage such that said shape memory alloy plug completely seals said open end when said shape memory alloy plug is at its second, larger diameter.

4. An assembly as set forth in claim 1 wherein said shape memory alloy plug generates a hoop stress on said fuel passage when said shape memory alloy plug is at said second, larger diameter.

5. An assembly as set forth in claim 1 wherein said shape memory alloy plug is made of a nickel-titanium-niobium alloy which undergoes a single, shape change from said first, smaller diameter to said second, larger diameter corresponding to said metallurgical phase change from martinsite to austenite.

6. An assembly as set forth in claim 5 wherein said nickel-titanium-niobium alloy has a composition of 48 weight percent nickel, 38 weight percent titanium, 12 weight percent niobium and 2 weight percent of other elements.

7. An assembly as set forth in claim 1 wherein said injector body includes a cylindrical bore and a plunger reciprocally received therein, said fuel passage defines a delivery portion extending between said control valve and said cylindrical bore in said injector body.

8. An assembly as set forth in claim 7 wherein said fuel passage defines a stub portion extending between said control valve and said at least one open end, said shape memory alloy plug inserted into and sealing said stub portion.

9. An assembly as set forth in claim 7 wherein said fuel passage defines a stub portion extending between said cylindrical bore and said at least one open end, said shape memory alloy plug inserted into and sealing said stub portion.

10. An assembly as set forth in claim 7 wherein said fuel passage is formed by drilling a hole from one side of said injector body so as to define said at least one opening and between said control valve and said cylindrical bore so as to define said fuel delivery portion.

11. An assembly as set forth in claim 7 wherein said fuel passage is formed by drilling a hole from one side of said injector body so as to define said at least one opening, through said cylindrical bore and between said cylindrical bore and said control valve so as to define said fuel delivery portion.

12. A method of manufacturing a fuel injector assembly for an internal combustion engine, said fuel injector assembly having a body with a fuel passage providing fluid communication between a control valve and a fuel nozzle assembly, said fuel passage defining at least one open end extending through said injector body and having an inner diameter, and a shape memory alloy plug sealing said at least one open end, said method comprising the steps of:

sizing said shape memory alloy plug such that it has a first diameter smaller than said inner diameter of said at least one open end while at a martinsitic state;

inserting said shape memory alloy plug into said at least one open end of said fuel passage;

inducing a metallurgical phase change in said shape memory alloy plug from martinsite to austenite such that said plug defines a second diameter in sealing engagement with said inner diameter to seal said fuel passage.

13. A method as set forth in claim 12 wherein said method includes a step of prestraining said shape memory alloy plug while it is in a martinsitic state before the step of sizing said shape memory alloy plug.

14. A method as set forth in claim 13 wherein said step of prestraining said shape memory alloy plug includes the step of cooling said plug to a temperature in the range of −100° C. to −55° C.

15. A method as set forth in claim 14 wherein said step of prestraining said shape memory alloy plug includes the step of cooling said plug to a temperature in the range of −100° C. to −80° C.

16. A method as set forth in claim 12 wherein said step of sizing said plug includes the steps of cutting a rod of shape memory alloy to a predetermined length and centerless grinding said shape memory alloy until said shape memory alloy plug has a first diameter which is smaller than said inner diameter of said at least one opening.

17. A method as set forth in claim 12 wherein the step of sizing said shape memory alloy plug includes maintaining the temperature of said shape memory alloy plug below 50° C.

18. A method as set forth in claim 12 wherein the said shape memory alloy plug is sized by measuring said fuel passage and selecting by category measurement said plug as prestrained and cut to a predetermined length.

19. A method as set forth in claim 12 wherein the step of inducing a metallurgical phase change includes heating said injector body at a temperature range between 65° C. and 200° C. to transform said shape memory alloy plug from its martinsitic to its austenitic state and such that said shape memory alloy plug defines said second, larger diameter and seals said fuel passage.

20. A method as set forth in claim 19 wherein the step of inducing a metallurgical phase change includes heating said injector body at a temperature of roughly 160° C. to transform said shape memory alloy plug from its martinsitic to its austenitic state.

* * * * *